United States Patent [19]

Beckett

[11] Patent Number: 4,915,780

[45] Date of Patent: Apr. 10, 1990

[54] PROCESS FOR MAKING AN ELEMENT FOR MICROWAVE HEATING

[75] Inventor: Donald E. Beckett, Mississauga, Canada

[73] Assignee: Beckett Industries Inc., Mississauga, Ontario, Canada

[21] Appl. No.: 353,206

[22] Filed: Apr. 12, 1989

Related U.S. Application Data

[63] Continuation of Ser. No. 10,182, Feb. 2, 1987, abandoned.

[51] Int. Cl.[4] ..... B44C 1/22; C23F 1/02; C03C 15/00; C03C 25/06

[52] U.S. Cl. ..... 156/661.1; 156/634; 156/656; 156/659.1; 156/665

[58] Field of Search ..... 156/629–634, 156/640, 656, 659.1, 661.1, 665, 345; 252/79.3, 79.5; 427/259, 264, 270, 271, 272; 428/201, 209; 219/10.55 E; 426/107, 420

[56] References Cited

U.S. PATENT DOCUMENTS

| | | | |
|---|---|---|---|
| 4,230,924 | 10/1980 | Brastad et al. | 219/10.55 E |
| 4,242,378 | 12/1980 | Arai | 427/270 X |
| 4,398,994 | 8/1983 | Beckett | 427/272 X |
| 4,552,614 | 11/1985 | Beckett | 156/640 |
| 4,610,755 | 9/1986 | Beckett | 156/345 X |
| 4,685,997 | 11/1987 | Beckett | 156/629 |

*Primary Examiner*—William A. Powell
*Attorney, Agent, or Firm*—Sim & McBurney

[57] ABSTRACT

A novel laminate of a partially-demetallized polymeric material web and stiff card is used to effect microwave reconstitution of frozen pizza with a more uniform cooking than previously achieved. The polymeric material web includes a metallized region having a central portion which has a first metal density and a peripheral portion having a lesser metal density. A novel demetallizing process is employed to achieve such differential metal density by applying etchant-resistant material to the metal surface through screen prior to etching, with the number of screen lines being varied to change the density.

3 Claims, 1 Drawing Sheet

PROCESS FOR MAKING AN ELEMENT FOR MICROWAVE HEATING

This is a continuation of Ser. No. 010,182, filed 2/2/87, now abandoned.

FIELD OF INVENTION

The present invention relates to a novel form of heating element for use in microwave heating of food products.

BACKGROUND TO THE INVENTION

The microwave heating and reconstitution of food products for consumption by the application of microwave energy is well known. Microwave heating occurs by the excitation of water molecules within the body of the food. This manner of heating is different from conventional oven heating, which involves heating from the exterior of the food product. While both methods are effective in heating food products, nevertheless one significant difference exists, in that microwave cooking does not produce browning or crisping of the exterior of the product.

This difference is of no significance with some food products but is of considerable significance with other products, such as those having a pastry shell, for example, a frozen pizza. Frozen pizzas reconstituted in a microwave oven tend to be soggy and lack crispness in the pastry whereas such crispness is attainable by conventional oven heating.

It has been suggested to supplement microwave cooking to achieve crispness of the type found with conventional oven heating to use a metallized sheet in contact with the pie crust. The concept is that the microwave energy is concentrated in the metallized sheet, thereby heating the metal layer, which in turn heats the food stuff by conduction from the heated metal layer, hoping thereby to produce a crispness in the pie crust.

While some success can be achieved in this regard, it has been found that the heating is uneven and, if the center portions of the pie crust are sufficiently crisped, the peripheral regions are overcooked and burned. If the peripheral regions are sufficiently crisp, then the inner regions remain insufficiently crisp.

SUMMARY OF INVENTION

In accordance with the present invention, this prior art microwave cooking problem is solved by providing a metallized sheet which has varying densities of metal at different locations thereon in order to provide different degrees of heating in different regions of the metallized sheet upon the application of microwave energy.

In the pizza example, the thickness of metal in the film is less at the peripheral regions of the pizza than in the inner regions, thereby permitting an even degree of cooking and crispness to be achieved in the whole diameter of the pie crust.

Accordingly, in one aspect of the present invention, there is provided a laminate comprising a layer of metallized flexible polymeric material having on one surface thereof at least one metallized region having a first metal density and at least one other discrete metallized region having a lower metal density than the first density, and at least one layer of other material laminated to the polymeric material layer.

The provision of a layer of metallized flexible polymeric material having the characteristics described above may be achieved by a novel selective demetallization procedure, which forms another aspect of the present invention.

In accordance, therefore, with another aspect of the invention, there is provided a method for the selective demetallization of a web of metallized flexible polymeric material having an etchant-removable metal layer on one surface thereof by a plurality of steps. In a first step, an etchant-resistant material is applied to the metal layer to provide at least one first region of the surface wherein the etchant-resistant material only partially covers and protects the metal layer and at least one second region of the surface from which the etchant-resistant material is absent. In a second step, an etchant material for the metal is applied to the surface to remove metal partially from the at least one first region and to remove metal completely from the at least one second region. In a third step, spent etchant is washed from the surface, thereby providing a partially-etched web having, in the at least one first region, a metal layer of decreased density with respect to the metal layer on the web and, in the at least one second region, no metal layer.

The provision of one metal layer of decreased density is achieved by applying etchant-resistant material by screening so that, in the second region, on a microscopic scale, a decreased density is achieved while, on a microscopic scale, there are provided closely-spaced regions from which metal has been etched and unetched regions having etchant-resistant material thereon.

GENERAL DESCRIPTION OF INVENTION

Figure 1:
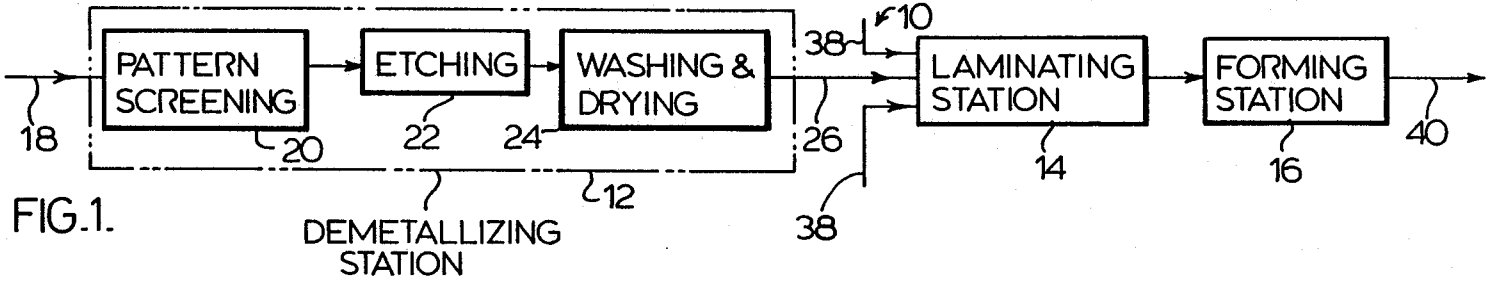
FIG. 1 is a schematic representation of a package forming operation embodying the novel demetallizing process of the invention.

I have previously invented a novel method of selective demetallization of metal from metal-coated polymeric material substrates, typically aluminized polyester film ("Mylar"), for a variety of purposes, for example, decorative packaging. The polymeric material substrate usually is transparent but may be translucent. My demetallization process is described in my U.S. Pat. Nos. 4,398,994, 4,552,614, 4,610,755, and 4,685,997, the disclosures of which patents are incorporated herein by reference.

As set forth therein, a pattern of demetallized regions may be formed on a web by a variety of techniques involving etching of predetermined regions of the web using, for example, an aqueous etchant to remove the metal from those regions while leaving the remainder of the metal surface unaffected.

The continuous procedures described in my prior patents enable the desired metallized regions to be provided on the polymeric material web rapidly and readily. The patterned web that results from the selective demetallization is in a convenient form for lamination with other materials to form a packaging laminate. The lamination operation may be effected using conventional laminating techniques. The lamination operation may be effected in-line with the demetallizing step or may be effected in a separate operation on a reel of selectively demetallized material The laminate, therefore, may be easily and readily formed using existing laminating techniques and equipment.

My prior demetallizing procedure has previously been adapted to the production of bags for microwave heating of popcorn, as described in my copending U.S. patent application No. 743,628 filed June 11, 1985, the disclosure of which is incorporated herein by reference. As described therein, strips of polymeric film are provided with a central metallized region and longitudinally adjacent demetallized regions, which then are laminated between two paper layers to form the blank from which the package is formed. The metallized region is arranged to be adjacent the popcorn to increase the heating thereof during microwave popping.

In the present invention, my prior demetallizing procedure is further modified to achieve not only selective complete demetallization of certain regions of the metallized film but also selective removal of part only of the metal in the metallized regions so as to provide selective and differing densities of metal in the metallized regions.

The metal film adhered to the polymer film may be any convenient metal which can be removed from the surface of the substrate by chemical etching. The metal usually is aluminum, but other etchable metals, such as copper, may be used. The thickness of the metal film may vary widely within the range of about 10 to about 1000 Å, preferably about 300 to about 600 Å, and may vary in appearance from opaque to transparent.

In the case of aluminum, the chemical etchant commonly employed is aqueous sodium hydroxide solution. The sodium hydroxide solution may have a concentration ranging widely up to about 25 wt.%, usually about 5 to about 10 wt.%. The temperature of the sodium hydroxide solution also may vary widely, from about 15° to about 100° C. Usually, hot sodium hydroxide solution is employed to speed up the etching process, generally about 50° to about 95° C. The sodium hydroxide solution is permitted to contact the metal surface for a time sufficient to permit etching to take place, usually about 0.1 to about 10 seconds, depending on the thickness of the metal film, the strength of the sodium hydroxide solution and the temperature of application.

In the selective demetallization procedures that I have previously described, either an etchant-resistant material first is applied to the metallized surface in a pattern of the regions that it is desired not to be etched by printing that pattern on the metallized surface followed by application of etchant material to the patterned surface, as described in my U.S. Pat. Nos. 3,398,994 and 4,552,614, or by printing etchant material directly on the metallized surface in the desired etched pattern, as described in my U.S. Pat. No. 4,610,755.

These prior processes do not permit varying densities of metal at different regions of the surface of the film to be achieved. Only two regions are possible, namely a completely-etched metal-free region and a completely-metallized region. The process of the present invention enables a region having a lesser density of metal than in the original untreated metal layer. By "density" in this context, is meant the quantity of metal per unit surface area of substrate.

This effect is achieved by screening the etchant-resistant material onto the surface in those regions where a lesser density of metal is desired. By applying the etchant-resistant material through a screen, the selected region of the surface does not have a continuous coating of etchant-resistant material but rather a discontinuous coating made up of many discrete spots or dots of etchant-resistant material with exposed small regions of metal between the spots. When the etchant is applied to this region, the small regions of metal are etched away while the etchant-resistant material dots protect the remainder of the metal from etching. The overall effect in the screened region after etching is a decreased density of metal thereon.

By altering the number of screen lines, the proportion of the screened region which is covered by etchant-resistant material may be varied and hence the density of unetched metal may be varied, and such variation may be effected within a particular region, in the event varying densities within one region are desired. It is not possible to achieve these effects in my prior art demetallizing process.

The screening application of etchant-resistant material may be combined with the conventional application of etchant-resistant material as described in my prior patents, so as to provide, after etching, metallized regions wherein the metal has the same density as the unetched film, metallized regions wherein the metal has a decreased density and completely etched regions.

The desired pattern of regions preferably is effected continuously on a web of metallized polymeric material, generally following the procedures described in my earlier patents. Continuous operation may be effected at high machine speeds, generally up to about 1000 ft/min or more, preferably about 500 to about 700 ft/min.

In the use of the partially-demetallized film for a container for microwave reconstitution of pizzas, lamination of the demetallized polymer film is required to prevent deformation of the polymeric film in the metallized regions upon application of microwave energy. For this reason, the layer or layers to which the polymeric film is laminated should be relatively-stiff, such as to provide a laminate which is able to resist deformation and distortion during the application of microwave energy. Usually, it is most convenient to sandwich the demetallized film between two outer layers of thin card.

For other applications, the layer or layers to which the demetallized film may be laminated may be another polymeric film, a paper sheet or any other convenient packaging material.

In the pizza tray application, the laminate generally is of square or rectangular shape with the demetallized polymeric layer having a central highly dense circular region corresponding in size to the main body of the pizza, an annular region of lesser density surrounding the periphery of the circular region corresponding to the peripheral region of the pizza and a remainder outside the annular region which is completely demetallized. If desired, the polymeric film may omit this remainder and comprise a circular body only.

The central highly dense region may have the same or a lesser density than the metal prior to demetallization while, in the peripheral region, the metal has a lesser density and the density may decrease uniformly from the inner to the outer periphery, if desired.

In this way, upon the application of microwave energy, the heating which results from the metal layer is concentrated in the central region of the pizza and is less intense at the periphery. The result is greater uniformity in the cooking of the pizza and avoidance of the burning of the crust in the peripheral regions.

The differential densities of metal at the different locations on the film may be achieved by varying the density of masking material applied to the metallized surface, prior to application of etchant to remove exposed metal. This technique is not limited to the formation of partially demetallized sheets for the pizza tray application, but is of general application, as earlier described.

DESCRIPTION OF PREFERRED EMBODIMENT

Referring to FIG. 1, there is illustrated therein a packaging line 10 comprising a demetallizing station 12, a laminating station 14 and a packaging station 16. While the stations 12, 14 and 16 are illustrated as being in-line, the stations may effect discrete operations, or two of the stations may be operated in-line, as desired.

A web of metallized polymeric material is continuously fed by line 18 to the demetallizing station 12, wherein it undergoes a plurality of operations. The web 18 first is subjected to pattern screening 20 to apply etchant-resistant material through screens of the desired pattern and line density. The patterned web then is subjected to etching 22, whereby an aqueous chemical etchant is applied to the web to dissolve metal from the regions of the web to which etchant-resistant material has not been applied. Spent etchant is washed at 24 from the web and the web is dried.

Figure 2:
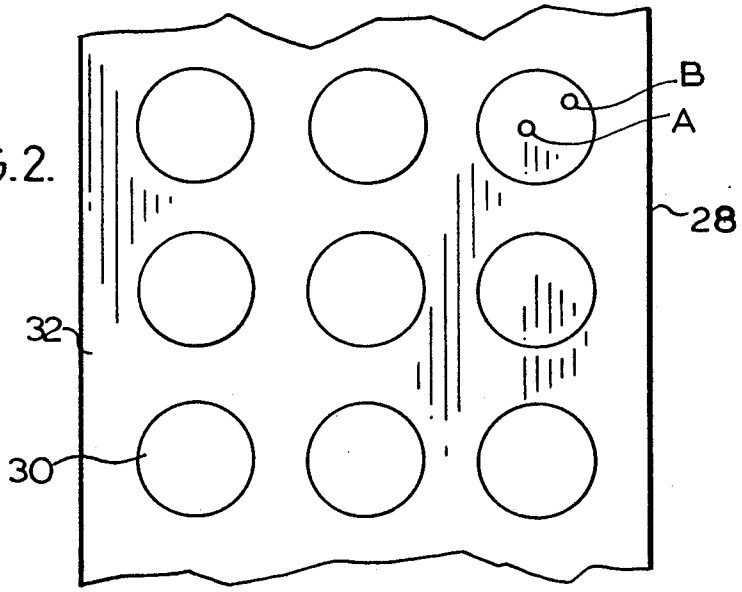
FIG. 2 is a plan view of a web of polymeric material illustrating the presence of discrete metallized regions.
Figure 3:
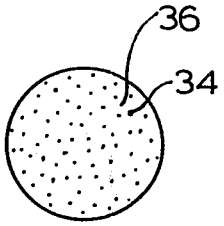
FIG. 3 is a close-up of region A of FIG. 2.
Figure 4:
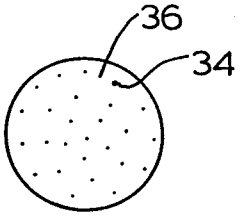
FIG. 4 is a close-up of region B of FIG. 2.

There results from the demetallizing station in line 26, a web 28 bearing the desired pattern. As seen in FIGS. 2 to 4, the web 28, for use with a frozen pizza tray for microwave reconstitution, comprises discrete metallized regions 30 which correspond in size to the pizzas to be packaged and completely demetallized regions 32 between the metallized regions 30. As may be seen in FIGS. 3 and 4, on a microscopic scale, in each of the metallized regions, there are a series of metallized dots 34 corresponding to the dots of etchant-resistant material applied through the screen and demetallized region 36 between the dots 34. The dots 34 are closer together in the central portion of the metallized region 30 (FIG. 3) than in the peripheral portion of the metallized region 30. This differential density is achieved by the line density of the screen used to apply the etchant-resistant material and ensures a different rate of heating at the peripheral region Following demetallizing, the web 28 is fed to the laminating station 14 wherein the demetallized web 28 is laminated with a pair of webs 38 of stiff card. The laminate of the polymeric material web 26 between the card webs 38 is forwarded to the packaging station 16, wherein the laminate may be formed into or incorporated into a package of the desired shape. The resulting package is recovered from the packaging station 16 in-line 40.

Alternatively, individual disks of the laminate comprising only the metallized region 30 of the web may be punched or otherwise removed from the laminate for use as inserts in or for incorporation into trays for frozen pizzas.

The preferred embodiment of the invention has been described with reference to the production of a novel form of pizza tray for microwave reconstitution of frozen pizzas. However, it will be clear from the above discussion that the principles thereof have wide application to a variety of packaging situations.

SUMMARY OF DISCLOSURE

In summary of this disclosure, the present invention provides a novel method for effecting selective demetallization of metallized polymeric material webs, so as to produce discrete demetallized regions having a decreased metal density, which also may vary within the demetallized region, for use in a variety of applications, including a novel laminate for microwave reconstitution of frozen pizzas to provide more uniform cooking. Modifications are possible within the scope of this invention.

What I claim is:

1. A method for the selected demetallization of a web of metallized flexible polymeric material having an etchant-removable metal layer on one surface thereof, which comprises:

screen applying to at least one first region of said metal layer an etchant resistant-material to provide in said at least one first region a plurality of dots of said etchant-resistant material only partially covering and protecting said metal layer to a degree determined by the number of screen lines of said screen and leaving exposed metal between said dots in said at least one first region;

applying to at least one second region of said metal layer separate from said at least one first region an etchant-resistant material to provide in said at least one second region said etchant-resistant material completely covering and protecting said metal layer in said at least one second region said screen application and said application of said etchant-resistant material leaving a third region of said metal layer between said at least one first region and said at least one second region from which said etchant-resistant material is absent;

applying to said metal layer an etchant material for said metal;

(i) to remove metal from said at least one first region in those exposed areas thereof not covered and protected by said plurality of dots of said etchant-resistant material, (ii) to remove no metal from said at least one second region by virtue of protection of said metal from said etchant by said covering of etchant-resistant material in said at least one second region, and (iii) to remove metal completely from said third region between said at least one first region and said at least one second region; and washing spent etchant from said metal layer, thereby providing a partially-etched web having:

(i) in said at least one first region, a metal layer of decreased density with respect to the metal layer on the web determined by the number of screen lines of said screen, (ii) in said at least one second region, a metal layer having a density the same as the metal layer on the web, and (iii) in said third region between said at least one first region and said at least one second region, a complete absence of metal layer.

2. The method of claim 1 wherein said etchantresistant material is screen applied to said at least one first region so as to provide differential metal densities within said at least one first region, each determined by the number of screen lines of said screen.

3. The method of claim 2 wherein said metal is aluminum and said etchant material is aqueous sodium hydroxide solution.

* * * * *